US010856583B2

(12) United States Patent
Fursa et al.

(10) Patent No.: US 10,856,583 B2
(45) Date of Patent: Dec. 8, 2020

(54) SUSPECTOR ASSEMBLY AND AEROSOL-GENERATING ARTICLE COMPRISING THE SAME

(71) Applicant: PHILIP MORRIS PRODUCTS S.A., Neuchatel (CH)

(72) Inventors: Oleg Fursa, Neuchatel (CH); Oleg Mironov, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 96 days.

(21) Appl. No.: 16/327,903

(22) PCT Filed: Aug. 31, 2017

(86) PCT No.: PCT/EP2017/071821

§ 371 (c)(1),
(2) Date: Feb. 25, 2019

(87) PCT Pub. No.: WO2018/041924

PCT Pub. Date: Mar. 8, 2018

(65) Prior Publication Data

US 2019/0216133 A1 Jul. 18, 2019

(30) Foreign Application Priority Data

Sep. 1, 2016 (EP) ..... 16186900

(51) Int. Cl.
*A24F 47/00* (2020.01)
*H05B 6/10* (2006.01)

(52) U.S. Cl.
CPC ..... *A24F 47/008* (2013.01); *H05B 6/108* (2013.01)

(58) Field of Classification Search
CPC ..... A24F 47/008; A24F 47/006
See application file for complete search history.

(56) References Cited

U.S. PATENT DOCUMENTS 4,256,945 A 3/1981 Carter
5,613,505 A * 3/1997 Campbell ..... A24F 47/008 131/194

FOREIGN PATENT DOCUMENTS

| | | |
|---|---|---|
| WO | WO 2015/177252 | 11/2015 |
| WO | WO 2015/177263 | 11/2015 |
| WO | WO 2015/177265 | 11/2015 |
| WO | WO 2015/177294 | 11/2015 |

OTHER PUBLICATIONS

PCT Search Report and Written Opinion for PCT/EP2017071821 dated Oct. 26, 2017 (11 pages).

* cited by examiner

*Primary Examiner* — Eric Yaary
*Assistant Examiner* — Jennifer A Kessie
(74) *Attorney, Agent, or Firm* — Mueting Raasch Group

(57) ABSTRACT

The invention refers to an aerosol-generating article comprising a susceptor assembly (1). The susceptor assembly for heating an aerosol-forming substrate comprises a first susceptor material (11) having an elongate shape and being coated with a coating material (3). The assembly further comprises a second susceptor material provided in the form of a plurality of susceptor particles (12) and having a second Curie temperature below 500 degree Celsius, wherein the susceptor particles are embedded in the coating material.

14 Claims, 1 Drawing Sheet

SUSPECTOR ASSEMBLY AND AEROSOL-GENERATING ARTICLE COMPRISING THE SAME

This application is a U.S. National Stage Application of International Application No. PCT/EP2017/071821 filed Aug. 31, 2017, which was published in English on Mar. 8, 2018, as International Publication No. WO 2018/041924 A1. International Application No. PCT/EP2017/071821 claims priority to European Application No. 16186900.3 filed Sep. 1, 2016.

The invention relates to a susceptor assembly for heating an aerosol-forming substrate and an aerosol-generating article comprising such a susceptor assembly.

Systems are known, where two different susceptor materials typically having different Curie temperatures are used to heat and control heating of an aerosol-forming substrate of an aerosol-generating article accommodated in an electronic smoking device. For example, in the international patent publication WO2015/177294 two strip-shaped susceptor materials are in intimate physical contact forming a susceptor assembly. One susceptor material is selected having a Curie temperature which corresponds to a predefined maximum heating temperature of the other susceptor material. Thus, the one susceptor material is optimized with regard to temperature control while the other susceptor material is optimized with regard to heating. However, the manufacture of such susceptor assemblies is not very cost efficient.

Thus, it would be desirable to have a susceptor assembly providing heating as well as temperature control, and that may be manufactured in a cost efficient and preferably simple manufacturing process.

According to the invention, there is provided a susceptor assembly for heating an aerosol-forming substrate. The susceptor assembly comprises a first susceptor material having an elongate shape and being coated with a coating material. The susceptor assembly further comprises a second susceptor material, which is provided in the form of a plurality of susceptor particles having a second Curie temperature below 500 degree Celsius. The susceptor particles are embedded in the coating material which coats the first susceptor material. The coating material may entirely or only partly cover the first susceptor material.

By providing a first and a second susceptor material, preferably having first and second Curie temperatures distinct from one another, the heating of the aerosol-forming substrate and the temperature control of the heating may be separated. While the first susceptor material may be optimized with regard to heat loss and thus heating efficiency, the second susceptor material may be optimized in respect of temperature control and does not need to have pronounced heating characteristics.

Thus, the plurality of particles that are basically only provided for temperature control purposes may be present in small amounts. The characteristic of the particles additionally allows a distribution of the second susceptor material over a relatively large area or over the entire volume of the coating material. Thus, temperature control may be achieved with small amounts of second susceptor material. Typical amounts of susceptor particles may range between 1 milligram and 5 milligram, for example between 3 milligram and 5 milligram.

Advantageously, the second susceptor material is selected having a Curie temperature, which corresponds to a predefined maximum heating temperature of the first susceptor material. The maximum heating temperature may be defined such that a local burning of surrounding material is avoided.

When a susceptor material reaches its Curie temperature, the magnetic properties change. At the Curie temperature the susceptor material changes from a ferromagnetic phase to a paramagnetic phase. At this point, heating based on energy loss due to orientation of ferromagnetic domains stops. Further heating is then mainly based on eddy current formation such that a heating process is automatically reduced upon reaching the Curie temperature of the susceptor material. Reducing the risk of overheating the aerosol-forming substrate may thus be supported by the use of susceptor materials having a Curie temperature, which allows a heating process due to hysteresis loss only up to a certain maximum temperature. Preferably, susceptor material and its Curie temperature are adapted to the composition of the aerosol-forming substrate to be heated in order to achieve an optimal temperature and temperature distribution in a tobacco product for an optimum aerosol generation.

The second Curie temperature of the second susceptor material is below 500 degree Celsius. Preferably, the second Curie temperature of the second susceptor material is selected such that upon being inductively heated an overall average temperature of an aerosol-forming substrate of an aerosol-forming substrate element in a corresponding article does not exceed 240° C. The overall average temperature of the aerosol-forming substrate here is defined as the arithmetic mean of a number of temperature measurements in central regions and in peripheral regions of the aerosol-forming substrate. Preferably, the second Curie temperature of the second susceptor material does not exceed 370° C. By this, local overheating of an aerosol-forming substrate of typical heat sticks used in electronic devices may be avoided.

The second Curie temperature may be between about 200 degree Celsius and about 450 degree Celsius, preferably between about 240 degree Celsius and about 400 degree Celsius, for example about 280 degree Celsius.

As a general rule, whenever a value is mentioned throughout this application, this is to be understood such that the value is explicitly disclosed. However, a value is also to be understood as not having to be exactly the particular value due to technical considerations.

Once the second susceptor material has reached its second Curie temperature, its magnetic properties change. At the second Curie temperature the second susceptor material reversibly changes from a ferromagnetic phase to a paramagnetic phase. During the inductive heating this phase-change of the second susceptor material may be detected on-line and the inductive heating may be stopped automatically.

For example a control unit, associated to a power supply of a device, may be capable of detecting when the second susceptor material has reached its Curie temperature (preferably corresponding to the maximum heating temperature of the first susceptor material) by monitoring the values of the current absorbed by the inductor.

Thus, an overheating of aerosol-forming substrate the susceptor assembly is accommodated in may be avoided, even though the first susceptor material, which is responsible for the heating of the aerosol-forming substrate, may not have a Curie temperature at all or may have a first Curie temperature, which is higher than the predefined maximum heating temperature. After the inductive heating has been stopped the second susceptor material cools down until it reaches a temperature lower than its second Curie temperature at which it regains its ferromagnetic properties again.

This phase change may again be detected on-line and the inductive heating may be activated again. The temperature control is accomplished contactless. A circuitry and electronics is preferably already integrated in an inductive heating device such that there is no need for any additional circuitry and electronics.

The first susceptor material, which is preferably optimized for the heating, preferably has a first Curie temperature, which is higher than the second Curie temperature and preferably higher than the predefined maximum heating temperature of the first susceptor material.

The elongate first susceptor has a length dimension that is greater than its width dimension or its thickness dimension, for example greater than twice its width dimension or its thickness dimension. Thus the first susceptor may be described as an elongate susceptor. The elongate susceptor basically defines the shape of the susceptor assembly, such that the assembly also comprises an elongate shape. Accordingly, a susceptor assembly is arranged substantially longitudinally within a rod-shaped element of an aerosol-generating article. This means that the length dimension of the elongate susceptor or susceptor assembly, respectively, is arranged to be approximately parallel to a longitudinal direction of a rod-shaped article, for example within plus or minus 10 degrees of parallel to the longitudinal direction of the article. In preferred embodiments, the elongate susceptor is positioned in a radially central position within the rod and extends along the longitudinal axis of the rod.

Preferably, the elongate first susceptor is in the form of a pin, rod, strip or blade. Preferably, the elongate susceptor has a length between 5 millimeter and 15 millimeter, for example, between 6 mm and 12 mm, or between 8 mm and 10 mm. A lateral extension of a first susceptor material may, for example, be between 0.5 mm and 8 mm, preferably between 1 mm and 6 mm, for example 4 millimeter. The elongate susceptor preferably has a width between 1 mm and 5 mm and may have a thickness between 0.01 mm and 2 mm, for example between 0.5 mm and 2 mm. In a preferred embodiment the elongate susceptor may have a thickness between 10 micrometer and 500 micrometer, or even more preferably between 10 and 100 micrometer. If the elongate susceptor has a constant cross-section, for example a circular cross-section, it has a preferable width or diameter between 1 millimeter and 5 millimeter. If the elongate susceptor has the form of a strip or blade, for example, is made of a sheet-like susceptor material, the strip or blade preferably has a rectangular shape having a width preferably between 2 millimeter and 8 millimeter, more preferably, between 3 mm and 5 mm, for example 4 mm and a thickness preferably between 0.03 millimeter and 0.15 millimeter, more preferably between 0.05 mm and 0.09 mm, for example 0.07 mm.

Preferably, the elongate first susceptor has a length which is the same or shorter than a length of an aerosol-forming substrate element, the susceptor assembly is arranged in. Preferably, the elongate susceptor has a same length as the aerosol-forming substrate element.

In embodiments wherein the first susceptor material has a flat or substantially flat shape defining two opposed large sides, for example wherein the elongate susceptor is a strip or blade, the coating material is provided on at least one side of the two opposed large sides of the first susceptor material. The coating material may be provided on only one or on both of the two opposed large sides of the first susceptor material. The coating material may be provided only partly on one or on both large sides.

The first susceptor material may be entirely coated with the coating material.

Preferably, the first susceptor material comprises a single coating material coating.

Preferably, the plurality of particles of the second susceptor material is homogeneously distributed in the coating material. By this, a temperature control in the coating material may be achieved rather uniformly over the extent of the coating material where it is coating the first susceptor material.

The susceptor particles may have sizes in a range of about 5 micrometer to about 100 micrometer, preferably in a range of about 10 micrometer to about 80 micrometer, for example have sizes between 20 micrometer and 50 micrometer.

The size of particles is herein understood as the equivalent spherical diameter. Since the particles may be of irregular shape, the equivalent spherical diameter defines the diameter of a sphere of equivalent volume as a particle of irregular shape.

The susceptor particles may comprise or may be made of a sintered material. Sintered material provides a wide variety of electric, magnetic and thermal properties. Sintered material may be of ceramic, metallic or plastic nature. Preferably, for susceptor particles metallic alloys are used. Preferably, sinter material for the particles used for the susceptor assembly according to the invention has a high thermal conductivity and a high magnetic permeability.

The susceptor particles as well as the first susceptor material may comprise an outer surface which is chemically inert. A chemically inert surface prevents the particles to take place in a chemical reaction or possibly serve as catalyst to initialize an undesired chemical reaction with the coating material the particles are embedded in, in particular with an aerosol-forming substrate coating. An inert chemical outer surface may be a chemically inert surface of the susceptor material itself. An inert chemical outer surface may also be a chemically inert cover layer that encapsulates the susceptor particles within the chemically inert cover. A cover material may withstand temperatures as high as the particles are heated. An encapsulation step may be integrated into a sinter process when the particles are manufactured. If the coating material is not itself an aerosol-forming substrate coating, the coating material may be chemically inert with respect to the coating material and the aerosol-forming substrate to be heated by the susceptor assembly. Chemically inert is herein understood with respect to chemical substances generated by heating the aerosol-forming substrate, in particular, a tobacco product.

The particles of the second susceptor material may be made of ferrite. Ferrite is a ferromagnet with a high magnetic permeability and especially suitable as susceptor material. Main component of ferrite is iron. Other metallic components, for example, zinc, nickel, manganese, or non-metallic components, for example silicon, may be present in varying amounts. Ferrite is a relatively inexpensive, commercially available material. Ferrite is available in particle form in the size ranges of the particles as mentioned herein. Preferably, the particles are a fully sintered ferrite powder, such as for example FP350 available by Powder Processing Technology LLC, USA.

The coating of the first susceptor material with a coating material provides a very close and direct physical contact between the coating material and the first susceptor material. Heat transfer from the first susceptor material to the coating material is optimized. The close contact leads to a fast heating up of the coating material. Thus, if the coating material is a tobacco or tobacco material containing coating material or an aerosol-forming substrate, a fast heating up of the aerosol-forming substrate in the coating may be achieved and by this a fast aerosol-formation from the aerosol-forming substrate of the coating material. This may lead to a short time to a first puff of an aerosol-generating device a susceptor assembly according to the invention is used with.

The coating material may basically be selected from any material suitable for the application in aerosol-generating devices. Coating materials may be any material that may withstand the heating temperatures in these devices, that may at these temperatures retain the susceptor particles in thermal proximity with the first susceptor material, and that are suitable for coating a susceptor material. A coating material may, for example, comprise or consist of a resin, glue or gel where the plurality of first susceptor particles is embedded in.

A coating material may be a substrate capable of forming aerosol or not forming an aerosol but retaining the susceptor particles. Such a substrate may, for example, be an aerosol-forming resin, a non-aerosol-forming resin, an aerosol-forming glue, a non-aerosol-forming glue or an aerosol-forming gel or a non-aerosol-forming gel.

A non-aerosol-forming coating is defined to not form an aerosol in the temperature range used in the aerosol-generating device, for example below 500 degree Celsius.

Preferably, a coating material is an aerosol-forming substrate, capable of forming an aerosol, preferably in the same temperature range as the aerosol-forming substrate to be heated by the coated first susceptor material.

Preferably, a coating material not being an aerosol-forming substrate is thermally conductive such that heat generated in the first susceptor is conducted through the coating material to a surrounding aerosol-forming substrate.

Thermal conductivity is the property of a material to conduct heat. Heat transfer occurs at a lower rate across materials of low thermal conductivity than across materials of high thermal conductivity. The thermal conductivity of a material may depend on temperature.

Thermally conductive materials as used in the present invention for the coating material may have thermal conductivities of more than 10 Watt per (meter×Kelvin), preferably more than 100 Watt per (meter×Kelvin), for example between 10 and 500 Watt per (meter×Kelvin).

The coating material may comprise additional components, for example, flavours, for example tobacco flavour, stimulating substances, for example, nicotine, or may comprise antioxidants.

Preferably, the coating material comprises tobacco or tobacco material to add to a smoking experience when the coating material is heated.

Preferably, a thickness of an aerosol-forming substrate coating may be between 80 micrometer and 1 millimeter, preferably between 100 micrometer and 600 micrometer, for example between 100 micrometer and 400 micrometer.

Preferably, thicknesses of a coating material not contributing to aerosol-formation, for example resin coatings, are smaller. Such coatings may be between 50 micrometer and 120 micrometer, preferably between 60 and 100 micrometer, the thickness may for example be below 100 micrometer, such as for example between 50 and 90 micrometer.

Coating of the first susceptor may be performed, for example, by deposition, dipcoating, spraying, painting or casting a coating material to an uncoated susceptor material.

These coating methods are standard reliable industrial processes that allow for mass production of coated objects. These coating processes also enable high product consistency in production and repeatability in performance of the susceptor assembly.

Preferably, an aerosol-forming substrate coating on the elongate first susceptor material is performed by one of the above mentioned methods by bringing an aerosol-forming substrate slurry onto an uncoated elongate first susceptor material.

Preferably, the coating material is the form of reconstituted tobacco formed from a tobacco-containing slurry.

According to the invention there is also provided an aerosol-generating article comprising a plurality of elements forming a rod. The plurality of elements comprises an aerosol-forming substrate element comprising a susceptor assembly according to the invention and as described herein. The aerosol-forming substrate element also comprises an aerosol-forming substrate bulk, wherein the susceptor assembly is arranged within the aerosol-forming substrate bulk.

The susceptor assembly may be arranged longitudinally within the aerosol-forming substrate element. Preferably, the susceptor assembly is arranged radially centrally within the aerosol-forming substrate element.

The aerosol-forming substrate bulk may comprise a gathered sheet of aerosol-forming substrate. Preferably, the aerosol-forming substrate bulk comprises a gathered sheet of homogenised tobacco material.

Aerosol-forming substrate as bulk or coating is a solid aerosol-forming substrate. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

The aerosol-forming substrate bulk may comprise, for example, one or more of: powder, granules, pellets, shreds, spaghetti strands, strips or sheets containing one or more of: herb leaf, tobacco leaf, fragments of tobacco ribs, reconstituted tobacco, homogenised tobacco, extruded tobacco and expanded tobacco. The aerosol-forming substrate bulk may be in loose form, or may be provided in a suitable container or cartridge. For example, the aerosol-forming material of the aerosol-forming substrate bulk may be contained within a paper or other wrapper and have the form of a plug. Where an aerosol-forming substrate bulk is in the form of a wrapped plug, the entire plug, including the coated first susceptor material including the second susceptor particles in the coating and including any wrapper forms the aerosol-forming substrate element.

Optionally, the aerosol-forming substrate may contain additional tobacco or non-tobacco volatile flavour compounds, to be released upon heating of the aerosol-forming substrate. The solid aerosol-forming substrate bulk may also contain capsules that, for example, include the additional tobacco or non-tobacco volatile flavour compounds and such capsules may melt during heating of the solid aerosol-forming substrate bulk.

The aerosol-forming substrate bulk may comprise one or more sheets of homogenised tobacco material that has been gathered into a rod, circumscribed by a wrapper, and cut to provide individual plugs of aerosol-forming substrate. Into this or these gathered, rod-shaped sheets the susceptor assembly is introduced before, during or after gathering the sheet into a rod. Preferably, the aerosol-forming substrate bulk comprises a crimped and gathered sheet of homogenised tobacco material.

The aerosol-forming substrate element may be substantially cylindrical in shape. The aerosol-forming substrate element may be substantially elongate. The aerosol-forming substrate element may also have a length and a circumference substantially perpendicular to the length.

Further, the aerosol-forming substrate element may have a length of 10 millimeter. Alternatively, the aerosol-forming substrate element may have a length of 12 millimeter. Further, the diameter of the aerosol-forming substrate element may be between 5 millimeter and 12 millimeter.

Tobacco containing slurry and a tobacco sheet forming the aerosol-forming substrate bulk as well as a coating made from the tobacco containing slurry comprises tobacco particles, fiber particles, aerosol former, binder and for example also flavours.

Preferably, the aerosol-forming tobacco substrate bulk is a tobacco sheet, preferably crimped, comprising tobacco material, fibers, binder and aerosol former. Preferably, the tobacco sheet is a cast leaf. Cast leaf is a form of reconstituted tobacco that is formed from a slurry including tobacco particles, fiber particles, aerosol former, binder and for example also flavours.

Preferably, a coating of coating material is a form of reconstituted tobacco that is formed from the tobacco containing slurry.

Tobacco particles may be of the form of a tobacco dust having particles in the order of 30 micrometers to 250 micrometers, preferably in the order of 30 micrometers to 80 micrometers or 100 micrometers to 250 micrometers, depending on the desired coating thickness or an a desired sheet thickness and casting gap, where the casting gap typically defined the thickness of the sheet.

Fiber particles may include tobacco stem materials, stalks or other tobacco plant material, and other cellulose-based fibers such as wood fibers having a low lignin content. Fiber particles may be selected based on the desire to produce a sufficient tensile strength for the coating or sheet versus a low inclusion rate, for example, an inclusion rate between approximately 2 percent to 15 percent. Alternatively, fibers, such as vegetable fibers, may be used either with the above fiber particles or in the alternative, including hemp and bamboo.

Aerosol formers included in the slurry for forming the cast leaf and the coating may be chosen based on one or more characteristics. Functionally, the aerosol former provides a mechanism that allows it to be volatilized and convey nicotine or flavouring or both in an aerosol when heated above the specific volatilization temperature of the aerosol former. Different aerosol formers typically vaporize at different temperatures. An aerosol former may be chosen based on its ability, for example, to remain stable at or around room temperature but able to volatize at a higher temperature, for example, between 40 degree Celsius and 450 degree Celsius. The aerosol former may also have humectant type properties that help maintain a desirable level of moisture in an aerosol-forming substrate when the substrate is composed of a tobacco-based product including tobacco particles. In particular, some aerosol formers are hygroscopic material that function as a humectant, that is, a material that helps keep a substrate containing the humectant moist.

One or more aerosol former may be combined to take advantage of one or more properties of the combined aerosol formers. For example, triacetin may be combined with glycerol and water to take advantage of the triacetin's ability to convey active components and the humectant properties of the glycerol.

Aerosol formers may be selected from the polyols, glycol ethers, polyol ester, esters, and fatty acids and may comprise one or more of the following compounds: glycerol, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

A typical process to produce a cast leaf or a slurry for an aerosol-forming substrate coating includes the step of preparing the tobacco. For this, tobacco is shredded. The shredded tobacco is then blended with other kinds of tobacco and grinded. Typically, other kinds of tobacco are other types of tobacco such as Virginia or Burley, or may for example also be differently treated tobacco. The blending and grinding steps may be switched. The fibers are prepared separately and preferably such as to be used for the slurry in the form of a solution. Since fibers are mainly present in the slurry for providing stability to a cast leaf or a coating, the amount of fibers may be reduced or fibers may even be omitted in a coating due to the aerosol-forming substrate coating being stabilized by the first susceptor material.

If present, the fiber solution and the prepared tobacco are then mixed, preferably together with the susceptor particles. The slurry may then be transferred to a coating device, for example a sheet forming apparatus or deposition device.

After coating, the aerosol-forming substrate is then dried, preferably by heat and cooled after drying.

The susceptor particles may also be applied to the slurry after having been brought into the form of a sheet or after having coated the first susceptor material, but before the sheet or coating is dried. By this, the susceptor particles are not homogeneously distributed inside the coating material but distributed on the surface of the coating.

Preferably, the tobacco containing slurry comprises homogenized tobacco material and comprises glycerol or propylene glycol as aerosol former. Preferably, the aerosol-forming substrate bulk and aerosol-forming substrate coating is made of a tobacco containing slurry as described above.

Advantageously, an aerosol-forming substrate coating the first susceptor or any other coating materials comprising volatile substances are porous to allow volatilized substances to leave the substrate. Due to the small thickness of the coating and its close contact to the first susceptor material also coatings having no or only little porosity may be used. A coating with small thickness may, for example, be chosen to have less porosity than a coating with larger thickness.

The aerosol-generating article has the form of a rod with a rod diameter, preferably in the range between about 3 millimeters to about 9 millimeters, more preferably between about 4 millimeters to about 8 millimeters, for example 7 millimeters. The rod may have a rod length in the range between about 2 millimeters to about 20 millimeters, preferably between about 6 millimeters to about 12 millimeters, for example 10 millimeters. Preferably, the rod has a circular or oval cross-section. However, the rod may also have the cross-section of a rectangle or of a polygon.

Further elements of the plurality of elements of the aerosol-generating article may, for example, be a mouthpiece element, a support element and an aerosol-cooling element.

The mouthpiece element may be located at a mouth end or a downstream end of the aerosol-generating article.

The mouthpiece element may comprise at least one filter segment. The filter segment may be a cellulose acetate filter plug made of cellulose acetate tow. A filter segment may be longitudinally spaced apart from the aerosol-forming substrate element.

Further features and advantages of the aerosol-generating article according to the invention have been described relating to the susceptor assembly according to the invention and will not be repeated.

According to yet another aspect of the invention there is provided an aerosol-generating system. The aerosol-generating system comprises an aerosol generating article according to the invention and as described herein. The system further comprises a power source connected to a load network, the load network comprising an inductor for being inductively coupled to the susceptor assembly of the aerosol-generating article.

The aerosol-generating system may further be equipped with an electronic control circuitry, which is adapted for a closed-loop control of the heating of the aerosol-forming substrate bulk of the aerosol-generating article. Thus, once the second susceptor material, which performs the function of temperature control, has reached its second Curie temperature where it changes its magnetic properties from ferromagnetic to paramagnetic, the heating may be stopped. When the second susceptor material has cooled down to a temperature below its second Curie temperature where its magnetic properties change back again from paramagnetic to ferromagnetic, the inductive heating of the aerosol-forming substrate may be automatically continued again. Thus, with the aerosol-generating system according to the invention the heating of the aerosol-forming substrate may be performed at a temperature which oscillates between the second Curie temperature and that temperature below the second Curie temperature, at which the second susceptor material regains its ferromagnetic properties.

The invention is further described with regard to embodiments, which are illustrated by means of the following drawings, wherein.

Figure 1:
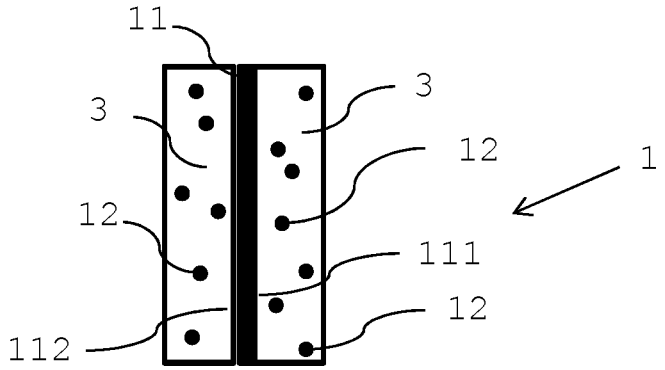
FIGS. 1,2 show a side view (FIG. 1) and a top view (FIG. 2) of a strip-shaped susceptor assembly.
Figure 2:
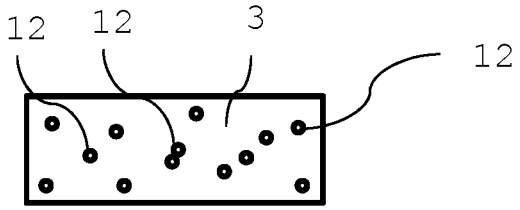

FIG. 1 and FIG. 2 show a side view and a top view of a susceptor assembly 1. The assembly includes a first susceptor material 11 having an elongated shape, and a second susceptor material in the form of susceptor particles 12. The first susceptor material 11 is coated with a coating material 3 in which the susceptor particles 12 are embedded. As the second susceptor material is introduced as a temperature marker, it is desirable that it is selected among materials having a Curie temperature below 500 degree Celsius, preferably below 400 degree Celsius.

The first susceptor material 11 has a substantially flat rectangular shape, defining two opposite large sides 111 and 112. In the example shown the coating material 3 is applied to both sides 111, 112, but it will be appreciated that the coating could be applied on one side only and only partially on one side.

In a preferred embodiment, the coating material 3 is an aerosol-forming substrate including tobacco material.

Figure 3:
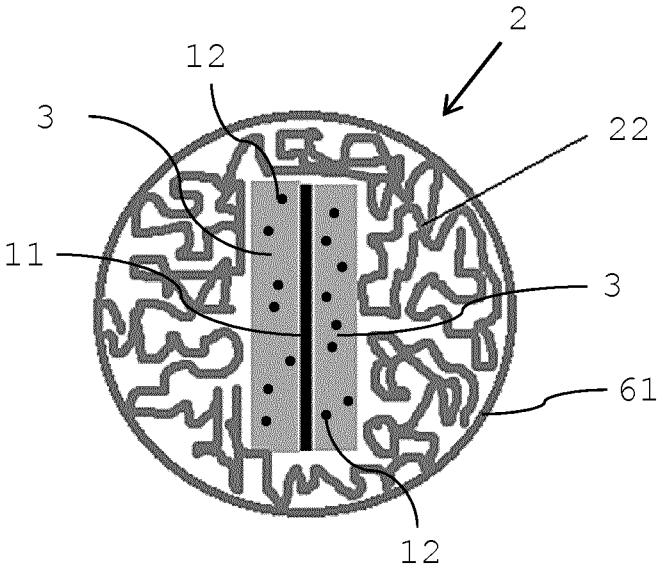
FIG. 3 is a cross sectional or bottom view of an aerosol-generating substrate element or aerosol-generating article comprising the susceptor assembly of FIGS. 1 and 2.

FIG. 3 shows a cross section through a rod-shaped aerosol-forming substrate element 2 or also a frontal section of an aerosol-generating article comprising the susceptor assembly 1 of FIG. 1.

The blade-shaped susceptor 11 is coated on its two longitudinal flat sides with a susceptor particles 12 containing aerosol-forming substrate coating 3. The aerosol-forming substrate coating 3 is in direct contact with the first susceptor 11. Preferably, the coating 3 is a dense tobacco containing coating, advantageously made from a corresponding tobacco containing slurry. The coating 3 has a thickness of about 100 micrometer on each large side of the susceptor blade 11. The coating 3 may serve as aerosol-forming substrate for a first puff.

The coated susceptor 11 is arranged radially centrally within a gathered cast leaf 22, which is wrapped with a paper wrapper 61 forming the rod-shaped aerosol-forming substrate element 2.

The invention claimed is:

1. Aerosol-generating article comprising a plurality of elements forming a rod, an aerosol-forming substrate element of the plurality of elements comprising a susceptor assembly for heating an aerosol-forming substrate and an aerosol-forming substrate bulk, wherein the susceptor assembly is arranged within the aerosol-forming substrate bulk, and wherein the susceptor assembly comprises a first susceptor material having an elongate shape and being coated with a coating material, and a second susceptor material provided in the form of a plurality of susceptor particles and having a second Curie temperature below 500 degree Celsius, wherein the susceptor particles are embedded in the coating material.

2. Aerosol-generating article according to claim 1, wherein the susceptor assembly is arranged radially centrally within the aerosol-forming substrate element.

3. Aerosol-generating article according to claim 1, wherein the aerosol-forming substrate bulk comprises a gathered sheet of homogenised tobacco material.

4. Aerosol-generating article according to claim 1, wherein the first susceptor material has a flat shape defining two opposed large sides, wherein the coating material is provided on at least one side of the two opposed large sides of the first susceptor material.

5. Aerosol-generating article according to claim 4, wherein the coating is provided on both of the two opposed large sides of the first susceptor material.

6. Aerosol-generating article according to claim 1, wherein a thickness of a coating material coating is between 50 micrometer and 1 millimeter.

7. Aerosol-generating article according to claim 1, wherein the coating material is a non-aerosol-forming substrate.

8. Aerosol-generating article according to claim 1, wherein the coating material comprises aerosol-forming substrate.

9. Aerosol-generating article according to claim 1, wherein the coating material comprises tobacco or tobacco material.

10. Aerosol-generating article according to claim 8, wherein an aerosol-forming substrate coating on the elongate susceptor is performed by one of deposition, dip-coating, spraying, painting or casting aerosol-forming substrate slurry onto an uncoated elongate susceptor material.

11. Aerosol-generating article according to claim 8, wherein the coating material is in the form of reconstituted tobacco formed from a tobacco-containing slurry.

12. Aerosol-generating article according to claim 1, wherein the first susceptor comprises a first Curie temperature, the second Curie temperature being lower than the first Curie temperature.

13. Aerosol-generating system comprising:

an aerosol generating article according to claim 1, and a power source connected to a load network, the load network comprising an inductor for being inductively coupled to the susceptor assembly of the aerosol-generating article.

14. Aerosol-generating system according to claim 13, further comprising an electronic control circuit adapted for a closed loop control of the heating of the aerosol forming substrate bulk.

* * * * *